United States Patent [19]

Percarpio et al.

[11] 4,293,078

[45] Oct. 6, 1981

[54] VACUUM INDICATOR CLOSURE FOR A BLOOD COLLECTION TUBE

[75] Inventors: Edward P. Percarpio, North Haledon; William J. Holderith, Wyckoff, both of N.J.

[73] Assignee: Becton, Dickinson and Company, Paramus, N.J.

[21] Appl. No.: 90,389

[22] Filed: Nov. 1, 1979

[51] Int. Cl.[3] ..... B65D 47/36

[52] U.S. Cl. ..... 215/247; 215/270; 215/271; 215/355

[58] Field of Search ..... 215/247, 270, 271, 355; 277/DIG. 10

[56] References Cited

U.S. PATENT DOCUMENTS

| | | | |
|---|---|---|---|
| 2,040,798 | 5/1936 | Schoonmaker | 215/271 |
| 2,266,270 | 12/1941 | Roth | 215/355 X |
| 2,634,014 | 4/1953 | Kimber | 215/271 X |
| 2,723,041 | 11/1955 | Hart-Still | 215/270 |
| 2,848,130 | 8/1958 | Jesnig | 215/247 X |
| 3,152,711 | 10/1964 | Mumford et al. | 215/271 |
| 3,160,302 | 12/1964 | Chaplin | 215/271 |
| 3,387,609 | 6/1968 | Shields | 215/247 X |
| 4,111,326 | 9/1978 | Percarpio | 215/270 X |

FOREIGN PATENT DOCUMENTS

| | | | |
|---|---|---|---|
| 968751 | 6/1975 | Canada | 215/247 |
| 1282024 | 12/1961 | France | 215/270 |
| 1330229 | 5/1963 | France | 215/270 |

*Primary Examiner*—Robert S. Ward, Jr.
*Attorney, Agent, or Firm*—Richard J. Rodrick

[57] ABSTRACT

A readily penetrable vacuum indicator closure for sealing an open end of an air evacuated blood collection tube. The closure comprises a flexible tubular body with an open first end and a closed second end formed by a penetrable, flexible end wall, with the end wall having an inner surface and an outer surface. When pressure on the inner and outer surfaces is substantially equal, the outer surface is convexly curved and the inner surface is concavely curved. This end wall is sufficiently flexible to deflect under the influence of a pressure differential on the end wall, such as may be perceived when the closure seals an evacuated blood collection tube. The outer surface of the flexible end wall is readily visible, thus serving as an indicator of relative pressures on opposite sides thereof. A flange is annularly disposed about the periphery of the tubular body adjacent to the second end.

14 Claims, 4 Drawing Figures

VACUUM INDICATOR CLOSURE FOR A BLOOD COLLECTION TUBE

BACKGROUND OF THE INVENTION

The present invention generally relates to a cannula-penetrable, self-sealing, gas proof closure for sealing an open end of an air evacuated blood collection tube, and more particularly, concerns a low penetration force closure for blood collection tubes with an indicator for visibly determining whether a vacuum condition is present inside the blood collection tube.

Self-sealing, gas proof elastomeric closures of various configurations are used extensively for sealing an open end of an air evacuated blood collection tube. These type closures not only provide an effective seal for maintaining a vacuum inside the collection tube, but also are penetrable by a cannula so that fluids may be deposited or withdrawn from the container without compromising the sterility of the container. While these types of closures have been utilized for a long time, improvements in their use and features are continually being sought. For example, U.S. Pat. No. 4,111,326 explains many deficiencies of prior closures, while offering improvements over these prior art closures, such as the use of less material for construction, reduction in manufacturing expense, easier assembly and a much lower force to penetrate with a needle, amongst other areas of improvement.

In addition to the many deficiencies of prior art closures as pointed out in U.S. Pat. No. 4,111,326, other problems arise in the use of air evacuated blood collection tubes. Specifically speaking, some blood collection tubes are inoperable due to the fact that something has caused the vacuum conditions inside the blood collection container to dissipate. These collection tubes, sometimes referred to in the art as "dead tubes," are not only non-functional, but also are oftentimes undetectable when "dead." In many instances, it is not until the operator of the collection tube is attempting to collect blood that it is realized that there is no vacuum inside the container.

Instead of relying upon effective quality control procedures to provide a favorable statistical expectation that the blood collection tube will work, a readily discernible, positive indication that each and every blood collection tube has the proper vacuum conditions is still being sought. While U.S. Pat. No. 4,111,326 indeed recognizes such a vacuum determination problem, and seeks to address and correct the same, it is not entirely successful in providing a superior indicator to the operator of the vacuum conditions inside the tube. For example, the means to determine the degree of vacuum loss such as measurement of bore depth or mechanical and optical means of measuring the curvature of the diaphragm at the bottom of the closure, may be time consuming and involve use of extra equipment. An improved way of determining whether or not the blood collection tube has the proper vacuum conditions is therefore still being sought, especially if such an improvement could be combined with the advantageous features of the closure described in U.S. Pat. No. 4,111,326. With such an improvement in mind, the present invention is hereby directed.

SUMMARY OF THE INVENTION

A readily penetrable vacuum indicator closure for sealing an open end of an air evacuated blood collection tube includes a substantially tubular flexible, elastomeric body having an open first end and a closed second end. This second end is formed by a cannula-penetrable, flexible elastic end wall having an outer surface and an inner surface. The outer surface of the end wall is convexly curved and the inner surface is concavely curved when pressure on the inner and outer surfaces is substantially equal. This end wall is sufficiently flexible to deflect under the influence of a pressure differential on the end wall so that when the pressure against the outer surface substantially exceeds the pressure against the inner surface, the outer surface becomes concavely curved and the inner surface becomes convexly curved. This condition occurs when there is a vacuum inside the blood collection tube. The outer surface of the end wall is readily visible to an observer with its changeable nature serving as an indicator of relative pressures on opposite sides of the end wall. A flange is annularly disposed about the periphery of the tubular body adjacent to the second end.

In order to provide a clear, visible, ready indicator to an observer, the outer surface of the end wall preferably convexly protrudes slightly above the plane defining the uppermost edge of the flange when pressures on both sides of the end wall are substantially equal. In other words, a slight bump is apparent to the observer which allows him to quickly identify that, inasmuch as the pressures on both sides of the end wall are substantially equal, proper vacuum conditions do not exist inside of the blood collection tube.

In one embodiment of the present invention, the tubular body of the closure has flexible, elastic side walls. These side walls include a taper on the interior surfaces extending outwardly toward the closed second end to thereby facilitate deflection of the end wall. This deflection of the end wall of the closure is merely the deflection of a thin diaphragm which is movably responsive to pressures against the same.

From the structural standpoint, the closure of the present invention is notably different from prior art closures useful in sealing air evacuated blood collection tubes. In particular, the flexible closed end of the closure is located at the uppermost portion of the combined closure and evacuated blood collection tube assembly. Thus, any deflection in the flexible closed end of the closure is readily apparent to the eye of the observer so that a quick determination can be made as to the vacuum conditions inside the blood collection tube. Accordingly, the structural configuration of the present invention provides a ready indicator to the user of the blood collection tube assembly that the proper vacuum conditions exist within. Inasmuch as this visual indicator allows such a quick determination, the present invention eliminates the need for more sophisticated, time consuming and more expensive techniques which the prior art relied upon in determining the vacuum conditions of the blood collection tube. In addition to the above, the present invention allows the cannula to penetrate the end wall with low penetration force due to its relatively thin character. This feature is a further advantage inasmuch as it reduces the instances where the cannula may pull the closure out of the collection tube when the cannula is withdrawn upon completion of the blood collection procedure. In one embodiment of this invention, the deflection of the flexible closed end provides additional sealing pressure of the closure against the collection tube due to the flexing action of the end wall as it deforms convexly under differential pressure. Other advantages of the present invention are offered as well.

DETAILED DESCRIPTION

Figure 1:
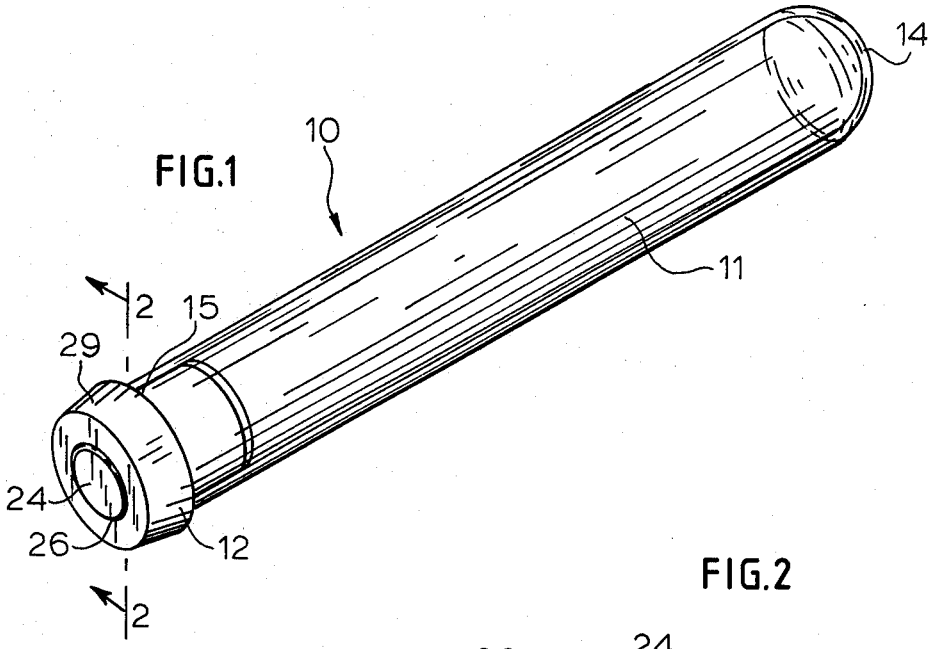
FIG. 1 is a perspective view of an air evacuated blood collection tube assembly with a readily penetrable vacuum indicator closure.

While this invention is satisfied by embodiments in many different forms, there is shown in the drawings and will herein be described in detail preferred embodiments of the invention, with the understanding that the present disclosure is to be considered as exemplary of the principles of the invention and is not intended to limit the invention to the embodiments illustrated. The scope of the invention will be pointed out in the appended claims.

Adverting to the drawings, particularly to FIG. 1, there is illustrated an air evacuated blood collection tube assembly comprising two general components, a blood collection tube or container 11 and a closure 12 therefor which is the primary emphasis of the present invention. Generally speaking, container 11 is an elongate tubular cylinder, such as a thin-walled glass vial, having a closed end 14 and an open end 15 so that air can be evacuated from the container for its proper utilization. Also in general terms, closure 12 is a cannula-penetrable, self-sealing, gas proof closure member positioned in sealing engagement in open end 15 of container 11 to maintain the vacuum inside the container.

Figure 2:
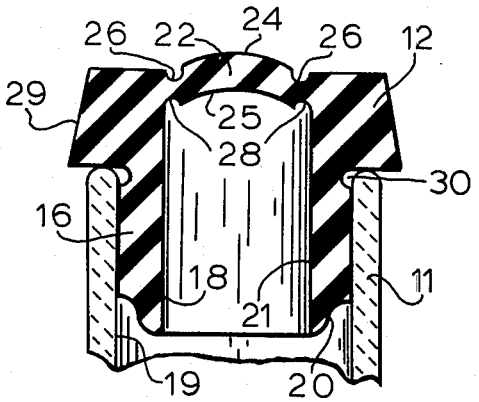
FIG. 2 is a cross-sectional view taken along line 2—2 of FIG. 1, illustrating the closure of the present invention as it would appear when there is no vacuum inside the blood collection tube.

Turning now to FIG. 2, taken in conjunction with FIG. 1, the structural configuration of closure 12 is illustrated in greater detail. Closure 12 is comprised of a tubular elastomeric body 16, preferably cylindrically shaped. Body 16 has flexible, elastic side walls 18, which are intended to snugly fit about their periphery in sealing engagement against the inside surface 19 of container 11. It is noted that the lowermost portion of side walls 18 includes a smooth radius 20 to form the leading edge of the closure and facilitate its assembly into the blood collection tube.

Tubular body 16 is also formed with an open first end 21 and a closed second end formed by a cannula-penetrable, flexible, elastic end wall 22 preferably integral with side walls 18. End wall 22 has an outer surface 24 and an inner surface 25. This end wall at the closed end of the closure is preferably a relatively thin, flexible diaphragm which spans the closed end of the closure. During formation of the closure, end wall 22 is configured to have its outer surface 24 convexly curved and its inner surface 25 concavely curved when pressure on the inner and outer surfaces is substantially equal. If, for example, there is, in reality, no vacuum inside blood collection tube 11, then the pressure on both sides of end wall 22 will be at substantially atmospheric levels thereby establishing the shape of the end wall as seen in FIG. 2. To the observer, end wall 22, under these conditions, appears as a dome-shaped protrusion, clearly discernible and readily apparent that there is no vacuum inside the blood collection tube. To facilitate the flexibility characteristic of end wall 22, an annular groove 26 and 28 is included on each of the outer and inner surfaces, respectively, adjacent to the side walls of the tubular body.

A flange 29, preferably integrally formed with side walls 18 is annularly disposed about the periphery of the side walls adjacent to the end wall at the second closed end of the tubular body. An undercut 30 is provided at the exterior meeting point of flange and side wall in order to assure a better fit of the closure inside the blood collection tube and to add greater flexibility to the side walls to increase side wall sealing of the closure to the blood collection tube. Flange 29 also serves as an abutment to position the closure in the open end of the blood collection tube. As seen in FIG. 2, outer surface 24 of the end wall preferably convexly protrudes slightly above the plane defining the uppermost edge of flange 29 when pressures on both sides of the end wall are substantially equal. This structure thereby provides a pronounced domelike effect to indicate to the observer that there is no vacuum inside the blood collection tube. The dome appearance is readily visible to the observer as an indicator of vacuum conditions inasmuch as the closed second end of the closure lies beyond the open end of container 11 preferably directly at the top of the entire blood collection tube assembly for clear visibility.

Figure 3:
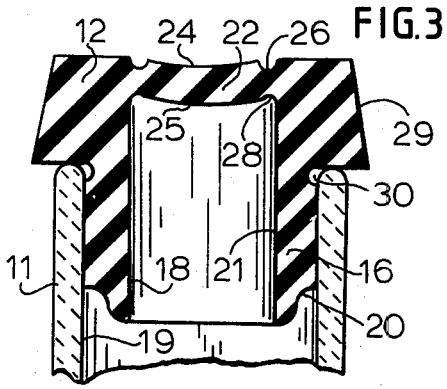
FIG. 3 is a cross-sectional view similar to that of FIG. 2 illustrating the closure of the present invention as it would appear when a vacuum condition exists inside the blood collection tube.

As alluded to above, end wall 22 being a relatively thin diaphragm is also sufficiently flexible to deflect under the influence of a pressure differential across the end wall surfaces. Such a deflection of the end wall is illustrated in FIG. 3 wherein a vacuum condition exists inside container 11. At this condition, the pressure against inside surface 25 is substantially less than the pressure against outside surface 24 which, under normal condition is generally at atmospheric pressure levels. With this kind of pressure differential across the end wall, outer surface 24 becomes concavely curved and inner surface 25 becomes convexly curved. Thus, the deflection of the end wall produces a clearly defined recess as seen by the observer; this observer will then be able to attribute such a recess to the fact that a vacuum condition does indeed exist inside the blood collection tube. As a preferred embodiment, when pressure against the outer surface substantially exceeds pressure against the inner surface of the end wall, the outer surface concavely rests slightly below the plane defining the uppermost edge of flange 29. Once again, the concavity of end wall 22 under vacuum conditions is a ready, quick indicator to the observer that the vacuum conditions exist.

As seen in FIG. 3, it is preferred that the concavity of outer surface 24 of the end wall not be too deep. In fact, a concavity of this outer surface just below the flattened position is most desirable because, in addition to the visual indication of vacuum which it provides, additional sealing between closure and collection tube results. As this end wall 22 tends to flatten out, as described above under vacuum conditions, its diameter increases and therefore exerts a radially outward force. This force contributes to providing a tighter seal between the closure and the blood collection tube. To maximize this contributing radial force, a substantially flattened end wall 22 under vacuum conditions can be designed and utilized. Of course, under these latter conditions with a substantially flattened end wall, the visual indicator feature is not as pronounced as when the end wall is clearly recessed inwardly under vacuum conditions inside the collection tube.

Figure 4:
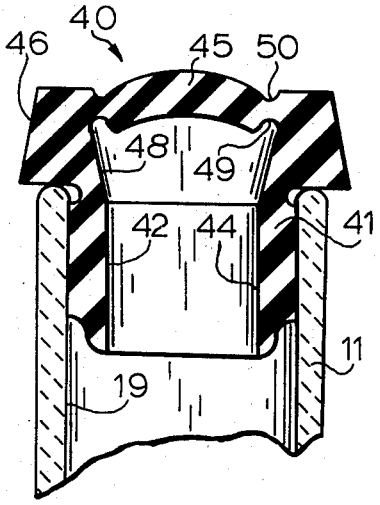
FIG. 4 is a cross-sectional view of another embodiment of the closure of the present invention as it would appear when there is no vacuum inside the blood collection tube.

Another embodiment of the closure of the present invention is illustrated in FIG. 4. This closure 40 is similar in most respects to the closure described with respect to FIGS. 1, 2 and 3. It includes a tubular elastomeric body 41 having flexible, elastic side walls 42, an open first end 44 and a closed second end formed by a cannula-penetrable, flexible elastic end wall 45, preferably integral with side walls 42. A flange 46 is annularly disposed about the periphery of the side walls adjacent to the second end. On the interior surface of tubular walls 42 is a taper 48 which extends outwardly toward the closed second end of the body. This taper terminates at its uppermost position at an annular groove 49 in the inner surface of the end wall. A similar annular groove 50 is located in the outer surface of the end wall opposite the first mentioned annular groove. In this embodiment, the purpose of taper 48 is to provide a larger diameter to end wall 45 than in the previous embodiment. When the end wall, being a thin, flexible diaphragm, has a larger diameter, it is able to yield more deflection for a particular diaphragm thickness. Accordingly, this greater deflection in end wall 45, particularly under vacuum conditions inside the blood collection tube, has a pronounced effect for visually indicating the vacuum conditions of the blood collection tube to the observer. In addition, with greater deflection of the end wall provided, its thickness could be somewhat increased to provide other advantages, for example, longer vacuum retention shelf life, while still retaining the advantageous vacuum indicator feature which thinner diaphragms provide.

The closure of the present invention is preferably a unitary piece molded of any flexible, elastomeric material conventionally used for fabricating such gas-proof closures. Representative of such materials are natural rubber, polyurethane elastomers, butyl rubber and the like. Preferred elastomeric materials are those of low gas permeability such as butyl rubbers having a Shore A hardness of between 35 to 80.

Dimensions of the closure may vary widely according to the dimension of the open end of the vacuum container to be sealed. To assure satisfactory sealing, the outside diameter of the tubular body around its side walls should be slightly larger than the inside diameter of the tubular vacuum container so that the body portion of the closure is under compression when inserted into the tubular container. The side walls and the end wall of the closure of the present invention are generally relatively thin in their respective thicknesses in order to retain their high flexibility while bearing structural integrity.

As an example of dimensions which may be utilized in a closure such as illustrated in FIGS. 1, 2 and 3 of the present invention having a height of between 0.303 in. (0.77 cm.) and 0.428 in. (1.09 cm.) and an average inside diameter of about 0.21 in. (0.53 cm.), the side wall may have a thickness of about 0.078 in. (0.2 cm.). In this embodiment, the end wall may have a thickness of between 0.06 in. (0.15 cm.) to 0.09 in. (0.23 cm.), while having a dome radius on its inside surface of about 0.46 in. (1.17 cm.). As an example of a closure as embodied in FIG. 4, most of the aforementioned dimensions could be utilized; however, the average inside diameter of the tubular body at the uppermost end of the taper (at its widest part) can be increased to about 0.26 in. (0.66 cm.), while having a dome radius on its inside surface of about 0.90 in. (2.29 cm.). In this second embodiment, the thickness of the end wall diaphragm may range from about 0.075 in. (0.19 cm.) to 0.09 in. (0.23 cm.). Also, in this instance, the angle of the taper (from the vertical) is approximately 14°, but, it is appreciated, may vary according to the size of the vacuum container being utilized.

Thus, the closure of the present invention provides, not only an effective seal in the open end of an air evacuated blood collection tube, but also serves as a visual indicator for readily determining whether or not a vacuum condition exists inside the blood collection tube.

What is claimed is:

1. A readily penetrable vacuum indicator closure for sealing an open end of an air evacuated blood collection tube comprising:

a tubular elastomeric body having flexible, elastic side walls, an open first end and a closed second end formed by a cannula-penetrable, flexible, elastic end wall intergral with said side walls, said end wall having an outer surface and an inner surface, said outer surface being convexly curved and said inner surface being concavely curved when pressure on said inner and outer surfaces is equal, said end wall being sufficiently flexible to deflect under the influence of a pressure differential on said end wall so that when pressure against said outer surface substantially exceeds the pressure against said inner surface, said outer surface becomes concavely curved and said inner surface becomes convexly curved, said outer surface being readily visible to an observer with its changeable nature serving as an indicator of relative pressures on opposite sides of said end wall, said outer surface being only slightly displaced from the flattened condition when concave to attribute a radially directed outward force to said end wall; and a flange annularly disposed about the periphery of said side walls adjacent to said second end.

2. A readily penetrable vacuum indicator closure for sealing an open end of an air evacuated blood collection tube comprising:

a tubular elastomeric body having flexible, elastic side walls, an open first end and a closed second end formed by a cannula-penetrable, flexible, elastic end wall integral with said side walls, said tubular walls including a taper on the interior surfaces thereof extending outwardly toward said closed second end to facilitate deflection of said end wall, said end wall having an outer surface and an inner surface, said outer surface being convexly curved and said inner surface being concavely curved when pressure on said inner and outer surfaces is equal, said end wall being sufficiently flexible to deflect under the influence of a pressure differential on said end wall so that when pressure against said outer surface substantially exceeds the pressure against said inner surface, said outer surface becomes concavely curved and said inner surface becomes convexly curved, said outer surface being readily visible to an observer with its changeable nature serving as an indicator of relative pressures on opposite sides of said end wall; and a flange annularly disposed about the periphery of said side walls adjacent to said second end.

3. The closure of claims 1 or 2 wherein said tubular body is cylindrical.

4. The closure of claims 1 or 2 wherein said flange is integrally formed with said side walls.

5. The closure of claims 1 or 2 wherein said end wall includes an annular groove on each of said inner and outer surfaces thereof adjacent to the side walls to facilitate the deflection of said end wall.

6. The closure of claims 1 or 2 wherein said outer surface of said end wall convexly protrudes slightly above the plane defining the uppermost edge of said flange when pressures on both sides of said end wall are substantially equal.

7. The closure of claim 6 wherein said outer surface of said end wall concavely rests slightly below the plane defining the uppermost edge of said flange when pressure against said outer surface substantially exceeds pressure against said inner surface.

8. The closure of claim 1 wherein said tubular body has an average diameter which bears a ratio to the height of the body of from 0.49:1 to 0.69:1 and to the thickness of the end wall of from 2.33:1 to 3.50:1.

9. The closure of claim 2 wherein said tubular body has an average diameter which bears a ratio to the height of the body of from 0.61:1 to 0.86:1 and to the thickness of the end wall of from 2.89:1 to 4.33:1.

10. A readily penetrable vacuum indicator closure for sealing an open end of an air evacuated blood collection tube comprising:

a substantially tubular, flexible elastomeric body having an open first end and a closed second end formed by a cannula-penetrable, flexible, elastic end wall, said end wall having an outer surface and an inner surface, said outer surface being convexly curved and said inner surface being concavely curved when pressure on said inner and outer surfaces is substantially equal, said end wall being sufficiently flexible to deflect under the influence of a pressure differential on said end wall so that when pressure against said outer surface substantially exceeds the pressure against said inner surface, said outer surface becomes concavely curved and said inner surface becomes convexly curved, said outer surface being readily visible to an observer with its changeable nature serving as an indicator of relative pressures on opposite sides of said end wall, said outer surface being only slightly displaced from the flattened condition when concave to attribute a radially directed outward force to said end wall; and a flange annularly disposed about the periphery of said tubular body adjacent to said second end.

11. A readily penetrable vacuum indicator closure for sealing an open end of an air evacuated blood collection tube comprising:

a substantially tubular, flexible elastomeric body having an open first end and a closed second end formed by a cannula-penetrable, flexible, elastic end wall, said end wall having an outer surface and an inner surface, said outer surface being convexly curved and said inner surface being concavely curved when pressure on said inner and outer surfaces is substantially equal, said end wall being sufficiently flexible to deflect under the influence of a pressure differential on said end wall so that when pressure against said outer surface substantially exceeds the pressure against said inner surface, said end wall becomes substantially flattened so that a radially directed outward force is attributed thereto, said outer surface being readily visible to an observer with its changeable nature serving as an indicator of relative pressures on opposite sides of said end wall; and a flange annularly disposed about the periphery of said tubular body adjacent to said second end.

12. An air evacuated blood collection tube assembly comprising an air evacuated tubular container having a closed end and an open end, and a cannula-penetrable, self-sealing, gas proof closure in sealing engagement in the open end of said container to maintain the vacuum inside said container, said closure comprising:

a substantially tubular, flexible elastomeric body having its periphery in sealing engagement against the inside surface of said container at its open end, said body having an open first end and a closed second end formed by a cannula-penetrable flexible, elastic end wall, said closure being positioned in said container so that its closed second end lies beyond the opened end of said container, said end wall having a convexly curved outer surface and a concavely curved inner surface when pressure on said inner and outer surfaces is equal, said end wall being sufficiently flexible to deflect under the influence of a pressure differential on said end wall so that when pressure against said outer surface substantially exceeds the pressure against said inner surface due to vacuum conditions inside said container, said outer surface becomes concavely curved and said inner surface becomes convexly curved, said outer surface being readily visible to an observer with its changeable nature serving as an indicator of relative pressures on opposite sides of said end wall, said outer surface being only slightly displaced from the flattened condition when concave so that said end wall is forced radially outwardly into tighter sealing engagement with the inside surface of said container than when said outer surface is convex; and a flange annularly disposed about the periphery of said tubular body adjacent to said second end, said flange serving as an abutment to position said closure in the open end of said container.

13. The closure of claims 1, 10 or 12 wherein said outer surface has a greater radius of curvature when concave than when convex.

14. The closure of claim 11 wherein said end wall has a greater cross-sectional diameter when flattened than when convex.

* * * * *